US010386019B2

(12) United States Patent
Watkins, II

(10) Patent No.: US 10,386,019 B2
(45) Date of Patent: Aug. 20, 2019

(54) FLOW CONTROL AND GAS METERING PROCESS

(71) Applicant: Southwire Company, LLC, Carrollton, GA (US)

(72) Inventor: Bobby G. Watkins, II, Mableton, GA (US)

(73) Assignee: Southwire Company, LLC, Carrollton, GA (US)

( * ) Notice: Subject to any disclaimer, the term of this patent is extended or adjusted under 35 U.S.C. 154(b) by 817 days.

(21) Appl. No.: 14/208,899

(22) Filed: Mar. 13, 2014

(65) Prior Publication Data

US 2014/0261784 A1 Sep. 18, 2014

Related U.S. Application Data

(60) Provisional application No. 61/790,315, filed on Mar. 15, 2013.

(51) Int. Cl.

| | |
|---|---|
| ***F23N 1/02*** | (2006.01) |
| ***F17D 3/01*** | (2006.01) |
| ***F23N 1/00*** | (2006.01) |
| *F23N 5/18* | (2006.01) |

(52) U.S. Cl.

CPC ..... *F17D 3/01* (2013.01); *F23N 1/002* (2013.01); *F23N 1/022* (2013.01); *F23N 2005/181* (2013.01); *F23N 2005/185* (2013.01); *F23N 2021/10* (2013.01); *Y10T 137/7782* (2015.04)

(58) Field of Classification Search

CPC ..... F17D 3/01

USPC ..... 431/11, 12

See application file for complete search history.

(56) References Cited

U.S. PATENT DOCUMENTS

| | | | | |
|---|---|---|---|---|
| 2,670,625 A | | 3/1954 | Snavely | |
| 2,777,320 A | | 1/1957 | Boulestreau | |
| 3,322,184 A | * | 5/1967 | Cofer | B22D 11/0665 164/123 |
| 3,561,895 A | * | 2/1971 | Michelson | F23D 14/04 137/13 |

(Continued)

FOREIGN PATENT DOCUMENTS

| | | |
|---|---|---|
| GB | 1463507 A | 2/1977 |
| GB | 2259023 A | 3/1993 |

(Continued)

OTHER PUBLICATIONS

PCT Search Report dated Jul. 2, 2014 in Appln No. PCT/US2014/025815, 12 pgs.

(Continued)

*Primary Examiner* — Vivek K Shirsat

(74) *Attorney, Agent, or Firm* — Merchant & Gould P.C.

(57) ABSTRACT

A system for controlling a flow may be provided. The system may comprise a first flow controller and a gas density meter. The gas density meter may be in fluid communication with the first flow controller. The gas density meter may be configured to calculate a gas density for a first gas flowing through the gas density meter. In addition, the gas density meter may be configured to output a first signal configured to cause the first flow controller to alter a first flow rate of the first gas flowing through the first flow controller. Furthermore, the gas density meter may be configured to output a density signal going to the second controller.

20 Claims, 5 Drawing Sheets

(56) References Cited

U.S. PATENT DOCUMENTS 4,010,645 A * 3/1977 Herzl ..... G01F 1/32 73/32 R
4,095,080 A * 6/1978 Ueyama ..... B23K 9/164 219/137.41
4,341,234 A 7/1982 Meinass et al.
4,545,009 A * 10/1985 Muraki ..... F23N 1/022 431/12
4,734,609 A 3/1988 Jasmine
4,767,313 A * 8/1988 Lockwood, Jr. ..... F02G 1/02 431/1
5,132,917 A * 7/1992 Bass ..... C10J 3/723 406/10
5,234,148 A 8/1993 Stone et al.
5,307,668 A 5/1994 Vander Heyden
5,325,852 A * 7/1994 Clem ..... G05D 21/02 137/101.19
5,641,915 A 6/1997 Ortiz et al.
5,671,785 A 9/1997 Andersson et al.
5,891,344 A * 4/1999 Liechti ..... C01B 13/10 162/65
6,113,384 A * 9/2000 Sebastiani ..... F23D 14/74 431/12
2002/0092339 A1 7/2002 Lee et al.
2005/0056338 A1* 3/2005 Hertzler ..... F17C 13/04 141/2
2006/0071016 A1 4/2006 Diggins
2008/0115502 A1* 5/2008 Roby ..... F02C 3/24 60/783
2009/0107959 A1 4/2009 Khakhalev et al.
2010/0139810 A1* 6/2010 Jorgensen ..... F23D 14/02 148/194
2010/0285413 A1* 11/2010 Borissov ..... F23C 5/32 431/7
2011/0098936 A1* 4/2011 Bats ..... G01N 33/225 702/24

FOREIGN PATENT DOCUMENTS

JP 55131621 A 10/1980
JP 57027197 A 2/1982
JP 57191424 A 11/1982
JP 5299411 A 11/1993
JP 11237637 A 8/1999
JP 2001090940 A 4/2001
JP 2012140896 A 7/2012
KR 1020040110474 A 12/2004
KR 1020100090010 A 8/2010
KR 100992869 B1 11/2010
TW 359664 B 6/1999
TW 200506174 A 2/2005
WO 2004008008 A2 1/2004
WO 2012072596 A1 6/2012
WO 2012119082 A1 9/2012
WO 2014151475 9/2014

OTHER PUBLICATIONS

Taiwanese Office Action dated Nov. 29, 2017 cited in Application No. 103109982, 7 pgs.

* cited by examiner

FLOW CONTROL AND GAS METERING PROCESS

CROSS-REFERENCE TO RELATED APPLICATIONS

The current application claims priority to U.S. Provisional Application No. 61/790,315, filed on Mar. 15, 2013 which is incorporated hereby by reference in its entirety.

COPYRIGHTS

All rights, including copyrights, in the material included herein are vested in and the property of the Applicants. The Applicants retain and reserve all rights in the material included herein, and grant permission to reproduce the material only in connection with reproduction of the granted patent and for no other purpose.

BACKGROUND

Copper rods are used to manufacture copper wire. Molten copper is poured into a casting wheel to allow for continuous copper rod production. To protect the casting wheel soot is deposited onto the wheel's surface.

BRIEF DESCRIPTION OF THE DRAWINGS

The accompanying drawings, which are incorporated in and constitute a part of this disclosure, illustrate various embodiments of the present invention. In the drawings.

DESCRIPTION

Figure 1:
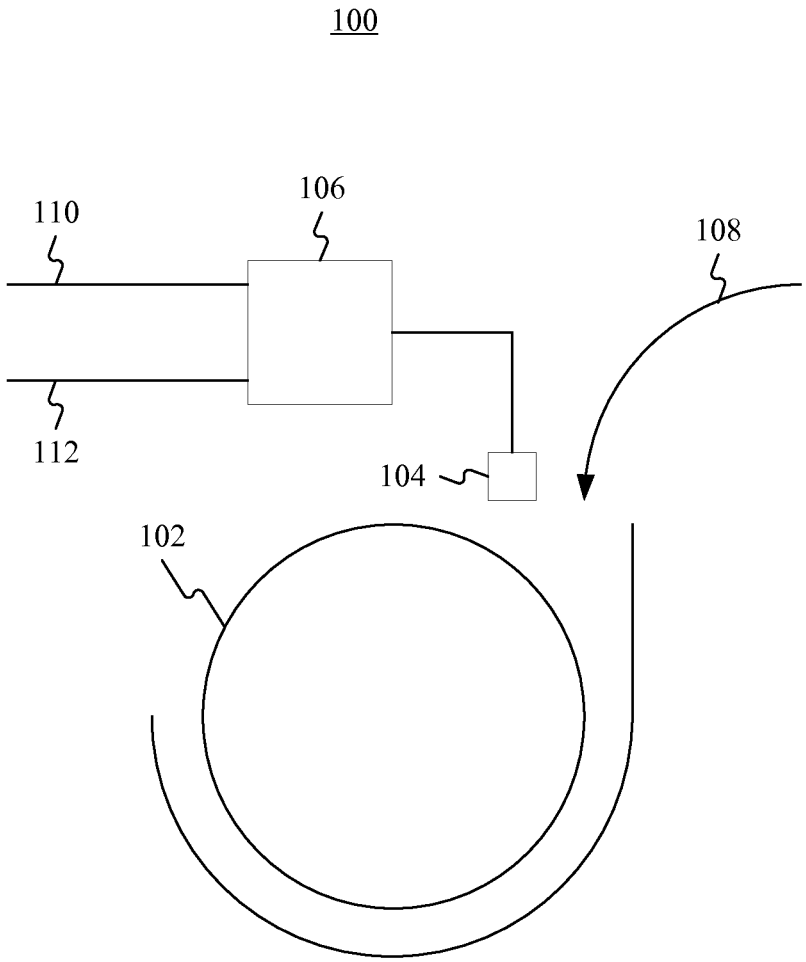
FIG. 1 shows a schematic for a casting operation.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

Consistent with embodiments of the invention, a system for controlling a flow may be provided. The system may comprise a first flow controller and a gas density meter. The gas density meter may be in fluid communication with the first flow controller. The gas density meter may be configured to calculate a gas density for a first gas flowing through the gas density meter. In addition, the gas density meter may be configured to output a first signal configured to cause the first flow controller to alter a first flow rate of the first gas flowing through the first flow controller. Furthermore, the gas density meter may be configured to output a density signal going to the second controller.

Consistent with embodiments of the invention, a method for metering a first gas flow may be provided. The method may comprise determining, at a gas density meter, a gas density of a first gas flowing through a first flow controller and receiving, at the first flow controller, a signal from the gas density meter. The signal may be configured to indicate the gas density of the first gas flowing through the first flow controller. In addition, the method may comprise adjusting the first gas flow based on the signal to maintain a preset mass flow rate for the first gas flowing through the first flow controller.

Consistent with embodiments of the invention, a method of manufacturing a system for metering a first gas flow may be provided. The method may comprise providing a gas density meter and providing a first flow controller in electrical communication with the gas density meter. The gas density meter may be configured to determine a gas density of a first gas of the first gas flow. The flow controller may be configured to receive a first signal configured to control the first flow controller. In addition, the method may comprise configuring the gas density meter to actuate the first flow controller in order to maintain, for example: i) a fixed flow rate of a gas; ii) predefined set point per condition; and iii) varying based on optimization.

FIG. 1 shows a schematic for a casting operation 100. Casting operation 100 may comprise a casting wheel 102, a sooter nozzle 104, and a flow control system 106. During operation, a molten copper flow 108, may be poured into casting wheel 102. To protect casting wheel 102 from the heat of the molten copper, soot may be deposited onto casting wheel 102. To deposit the soot, a first gas flow 110 (e.g., acetylene) may be combusted with a second gas flow 112 (e.g., oxygen).

To create the soot, a gas (e.g., hydrocarbon gas) may be combusted at sooter nozzle 104. The hydrocarbon gas may include acetylene, methane, natural gas, propane or other types of hydrocarbon fuel gas. The combustion process may be controlled using a secondary gas (e.g., oxygen). Certain gases, such as for example acetylene, have low flash points. As such, to increase safety during transportation, the gases may be dissolved into a solution. For example, acetylene may be dissolved in acetone.

In certain industrial processes, acetylene may be combusted with oxygen to create soot. Acetylene has a flash point normally below room temperature when compressed. To raise the flash point acetone is added to the container. For processes such as cutting and brazing, the presence of acetone may not be problematic. This is due to the irrelevance of the byproduct of the burned hydrocarbon gas in the industrial utilitarian of cutting and brazing. However, during the casting of copper rods, the combustion process needs to be precisely controlled to ensure a proper soot formation. The proper soot formation may protect the casting wheel that may cost in excess of $100,000.

Figure 2:
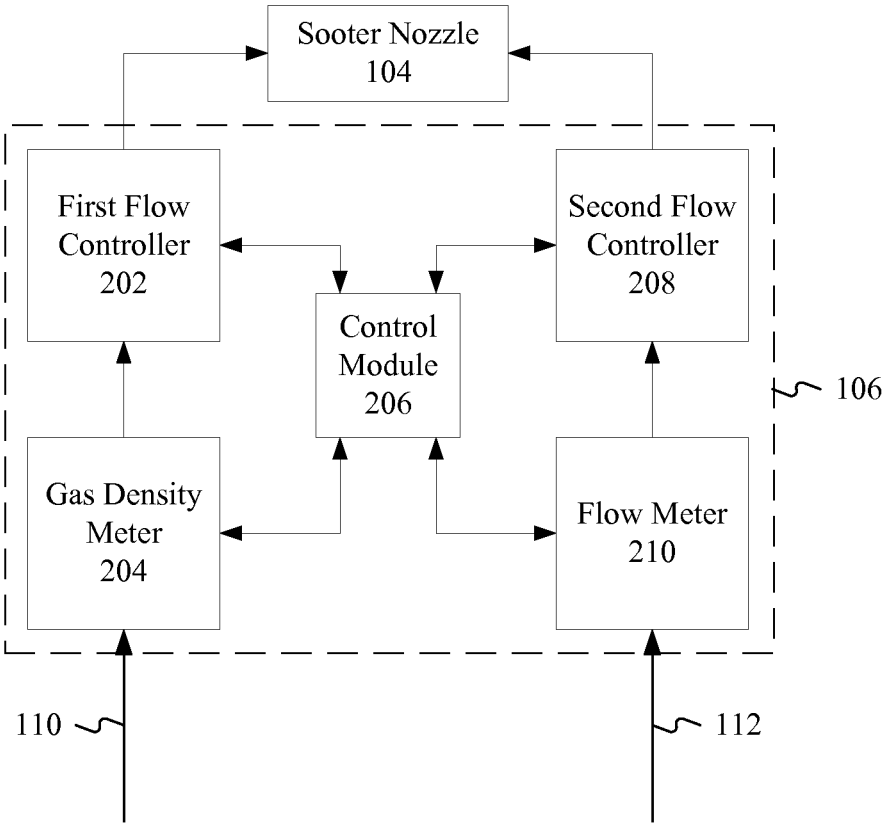
FIG. 2 shows a flow control system.

FIG. 2 shows a flow control system 106. Flow control system 106 may comprise a first flow controller 202, a gas density meter 204, a control module 206, and a second flow controller 208. First flow controller 202 may be in fluid communication with gas density meter 204. First flow controller 202 may be in fluid communication with sooter nozzle 104. First flow controller 202 may output signals to control module 206. The signals may indicate pressure, temperature, mass flow, volumetric flow, and total volume.

Gas density meter 204 may be configured to calculate a gas density for a first gas (e.g., an acetone/acetylene mixture). The first gas may be flowing through gas density meter 204 and first flow controller 202. The gas density may be the density of a component of the first gas (e.g., the density of acetone or the density of acetylene). In addition, the gas density may be the density of the mixture (e.g., the density of the acetone and acetylene mixture).

Gas density meter 204 may be configured to output a first signal. The first signal may be configured to cause first flow controller 202 to alter a first flow rate of the first gas flowing through first flow controller 202. For example, gas density meter 204 may transmit the signal directly to first flow controller 202 that may cause first flow controller 202 to increase or decrease the flow of the first gas. In addition, gas density meter 204 may transmit the signal to control module 206. Control module 206 may process the signal and transmit another signal to first flow controller 202 to increase or decrease the flow of the first gas.

A certain gas density may be desired. For example, a preset gas density of acetylene may be desire. The preset gas density may allow for a constant or fixed number of carbon atoms to reach sooter nozzle 104 for combustion. As the acetylene escapes the acetone solution, a portion of the acetone may vaporize and mix with the acetylene. Gas density meter 204 may detect the percent weight of acetylene and the percent weight of acetone in the mixture. Based on the percent weights, gas density meter 204 may output the signal to control first flow controller 202. The signal may allow for first flow controller 202 to control the percent weight of acetylene flowing. and the percent weight of acetone flowing. In other words, first flow controller 202 may control the mass/volume flow rates for each constituent of the gas flow or the mass/volume flow rate for combined the gas flow.

Gas density meter 204 may have a low response time to calculate the gas density. For example, gas density meter 204 may be able to calculate the gas density, or changes in gas density, with a response time of less than about 0.1 seconds. Furthermore, because gas density meter 204 may be able to control the gas flow, flow control system 106 may maintain a high percent weight of acetylene in the flow. For example, using flow control system 106, the vaporization of acetone can be minimized such that at least 80% of the flow may be acetylene. Furthermore, flow control system 106 may be accurate enough to control the desorption of acetylene that 100% of the flow may be acetylene.

Moreover, using flow control system 106, gas density meter 204 and first flow controller 202 may allow for nearly all the acetylene to be extracted from a tank. This may increase efficiency. Currently, for example, when a tank reaches an amount of usage (e.g., run time, given pressure within the tank, etc.), the tank may be declared "empty" even though usable acetylene may remain in the tank. This results in already purchased acetylene being sent back to a distributor instead of being combusted to form soot, or used to perform welding, cutting, etc.

Second flow controller 208 may be in fluid and electrical communication with a flow meter 210. Flow meter 210 may be configured to output a second signal. The second signal may be configured to cause second flow controller 208 to alter a second flow rate of a second gas (e.g., oxygen) flowing through second flow controller 208. Second flow controller 208 may output signals to the control module 206. The signals may indicate pressure and temperature.

Control module 206 may be configured to alter the flow of the first gas (e.g., acetylene) and the flow of the second gas (e.g., oxygen). For example, control module 206 may alter the flow of acetylene and the flow of oxygen simultaneously based on the first signal and the second signal. In addition, control module 206 may alter the flow of acetylene or oxygen independently of each other based on the first signal and the second signal.

The flow of the first gas and the second may be altered independently of a back pressure and an inlet pressure. For example, as an internal pressure with an acetylene tank may drop as the acetylene tank becomes depleted. As the internal pressure, temperature, and or delivery density drops, flow control system 106 may alter the flow of acetylene, oxygen, or both to maintain a desired soot output, temperature, and delivery density.

The desired soot output may be a function of parameters such as for example, tank pressures, atmospheric pressure, ambient temperature, a rotation speed of casting wheel 102, and a temperature of the molten copper. These parameters may be monitored by control module 206. Using the parameters control module 206 may automatically alter the first flow and the second flow to achieve the desired soot output. For example, when the rotation speed of casting wheel 102 and the temperature of the molten copper remain constant and ambient temperature and atmospheric pressure vary and a two-dimensional matrix may be created. The matrix may allow control module 206 to select the preset gas density based on the atmospheric pressure and the ambient temperature.

Using the parameters control module 206 to automatically alter the first flow and the second flow may enable a consistent soot output. Setting the mass flow rate of the first flow may enable ninety-nine percent of the actual flow falling within no more or less than 0.221 standard liter per minute of the set flow rate. Likewise, setting the mass flow rate of the second flow may enable ninety-nine percent of the actual flow falling within no more or less than 0.0339 standard liter per minute of the set flow rate. As a result, the soot production of the desired first flow and second flow may be very accurate, i.e. close to the set point, as well as very precise, i.e. small variation in values.

The consistent soot output may enable a standard deviation in temperature of the molten copper, which in turn may produce a quality-casting rod. This analysis helps to establish potential utilization of these findings to increase sooting proficiency. The calculated average temperature and standard deviations are quantitative inputs for developing objective sooting guidelines centrally focused on specifying optimal temperature gradients (i.e. top graded coil average bar-wheel temperature difference) and optimal temperature ranges (i.e. standard deviation of bar-wheel temperature difference). The core impetus of system performance consistency and full system automation is pursued through less dependence on operator subjective interpretations and human variability as compared to quantitatively determined strategies for specifying sooter strategies.

In addition, Table 1 indicates using the parameters control module 206 to automatically alter the first flow and the second flow may enable a decreased acetylene usage by at least five-percent. In Table 1, the acetylene consumption immediately before using the parameters control module 206 is shown in the first column. The acetylene consumption immediately after using the parameters control module 206 is shown in the second column. As indicated in column three, the number of acetylene cubic feet consumed per million pounds of copper rod produced may be reduced by at least five-percent.

TABLE 1

| Average Consumption Before | Average Consumption After | Percent Reduction |
|---|---|---|
| 2505 | 2380 | 4.99001996 |

Furthermore, as indicated in Table 2, using the parameters control module 206 to automatically alter the first flow and the second flow may prolong a wheel life by at least sixteen-percent. In Table 1, the number of pounds of casting rod produced per wheel immediately before using the parameters control module 206 is shown in the first column. The number of pounds of casting rod produced per wheel immediately after using the parameters control module 206 is shown in the second column. Reviewing the change in casting rod production per wheel, the wheel life may be increased by at least sixteen-percent.

TABLE 2

| Average Production Per Wheel Before | Average Production Per Wheel After | Percent Increase |
|---|---|---|
| 206 | 239 | 16.0194175 |

Figure 3:
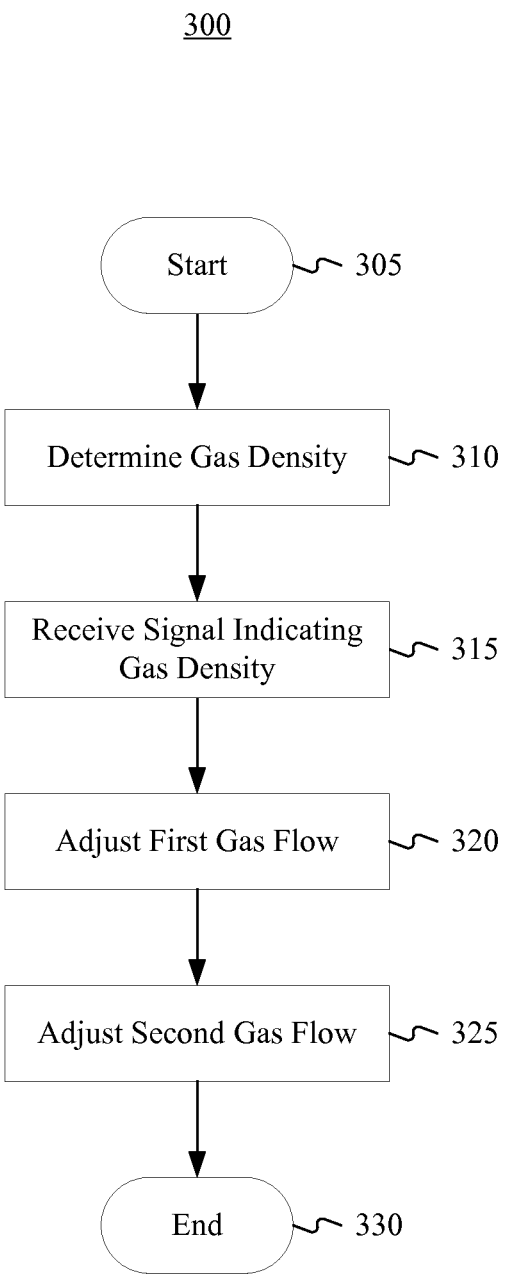
FIG. 3 shows a flow chart for a method for metering a first gas flow.

FIG. 3 shows a flow chart for a method 300 for metering the first gas flow. The method may begin at starting block 305 and progress to stage 310 where gas density meter 204 may determine a gas density of the first gas flowing through first flow controller 202. As described above the gas density may be determined for the first gas flow as a whole. In addition, the gas density of each component of the first gas flow may be determined.

From stage 310 where the gas density is determined, method 300 may proceed to stage 315, where first controller 202 may receive the signal from gas density meter 204. The signal may be configured to indicate the gas density of the first gas flowing through first flow controller 202. As described above, the signal may be generated by gas density meter 204 or control module 206. For example, the first gas may comprise an acetone and acetylene gas mixture and determining the gas density may comprise determining an acetylene gas density within the acetone and acetylene gas mixture.

From stage 315 where the signal is received, method 300 may proceed to stage 320 where the first gas flow may be adjusted. The first gas flow may be adjusted to maintain the preset gas flow rate (e.g. mass/volume) for the first gas flowing through the first flow controller. As described above, the preset gas flow rate may allow for a molar volume or molar mass of carbon to be delivered to sooter nozzle 104. For example, the preset gas flow rate may comprise a preset acetylene gas density and the gas flow may be adjusted to maintain a flow of acetylene to achieve the acetylene gas equal to the preset acetylene gas density. By adjusting the flow based on the mass density readings, the percent weight of acetylene within the acetylene/acetone flow may be adjusted.

From stage 320 where the first gas flow is adjusted, method 300 may proceed to stage 325 where the second gas flow may be adjusted. For example, based on ambient temperature and atmospheric pressure, a flow of oxygen may need to be increased or decreased. At stage 325 the flow of oxygen may be increase or decrease to achieve a desired oxygen/acetylene ratio. The desired oxygen/acetylene ratio may generate the desired soot composition, deposition, combustion, pyrolysis, temperature, flame characteristics, etc.

Furthermore, the ambient temperature and/or atmospheric pressure may change. When this occurs, the first gas flow and the second gas flow may be adjusted to achieve the desired oxygen/acetylene ratio to generate the desired soot composition, deposition, combustion, pyrolysis, temperature, flame characteristics, etc. After the second gas flow is adjusted at stage 325, method 300 may terminate at termination block 330.

Figure 4:
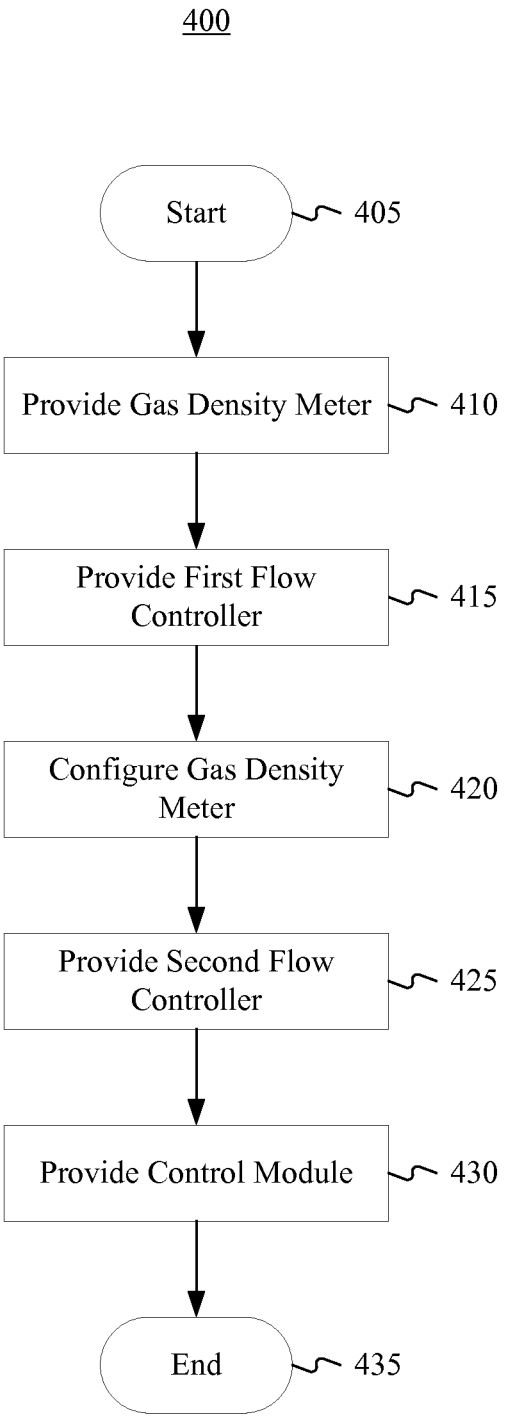
FIG. 4 shows a flow chart for a method for manufacturing a system for metering a gas flow.

FIG. 4 shows a flow chart for a method 400 for manufacture a system for metering the first gas flow. Method 400 may being at start block 405 and may proceed to stage 410 where gas density meter 204 may be provided. As described above, gas density meter may be configured to determine the gas density of the first gas of the first gas flow.

From stage 410 where gas density meter 204 is provided, method 400 may proceed to stage 415 where first flow controller 202 may be provided. As described above first flow controller 202 may be configured to receive the first signal. The first signal may be configured to control first flow controller 202.

From stage 410 where first flow controller 202 is provided, method 400 may proceed to stage 420 where gas density meter 204 may be configured to actuate first flow controller 202 in order to maintain a fixed or optimally varied flow rate flow rate of the first gas. For example, as described above, the gas density meter may be configured to actuate first flow controller 202 in order to maintain a constant mass flow rate of acetylene.

From stage 420 where gas density meter 204 is configured, method 400 may proceed to stage 425 where second flow controller 208 may be provided. As described above, second flow controller 208 may be configured to control the second gas flow.

From stage 425 where second flow controller 208 is provided, method 400 may proceed to stage 430 where control module 206 may be provided. As described above control module 206 may be configured to adjust the first gas flow and the second gas flow to maintain the preset ratio of the first gas to the second gas. From stage 430, method 400 may terminate at termination block 435.

Figure 5:
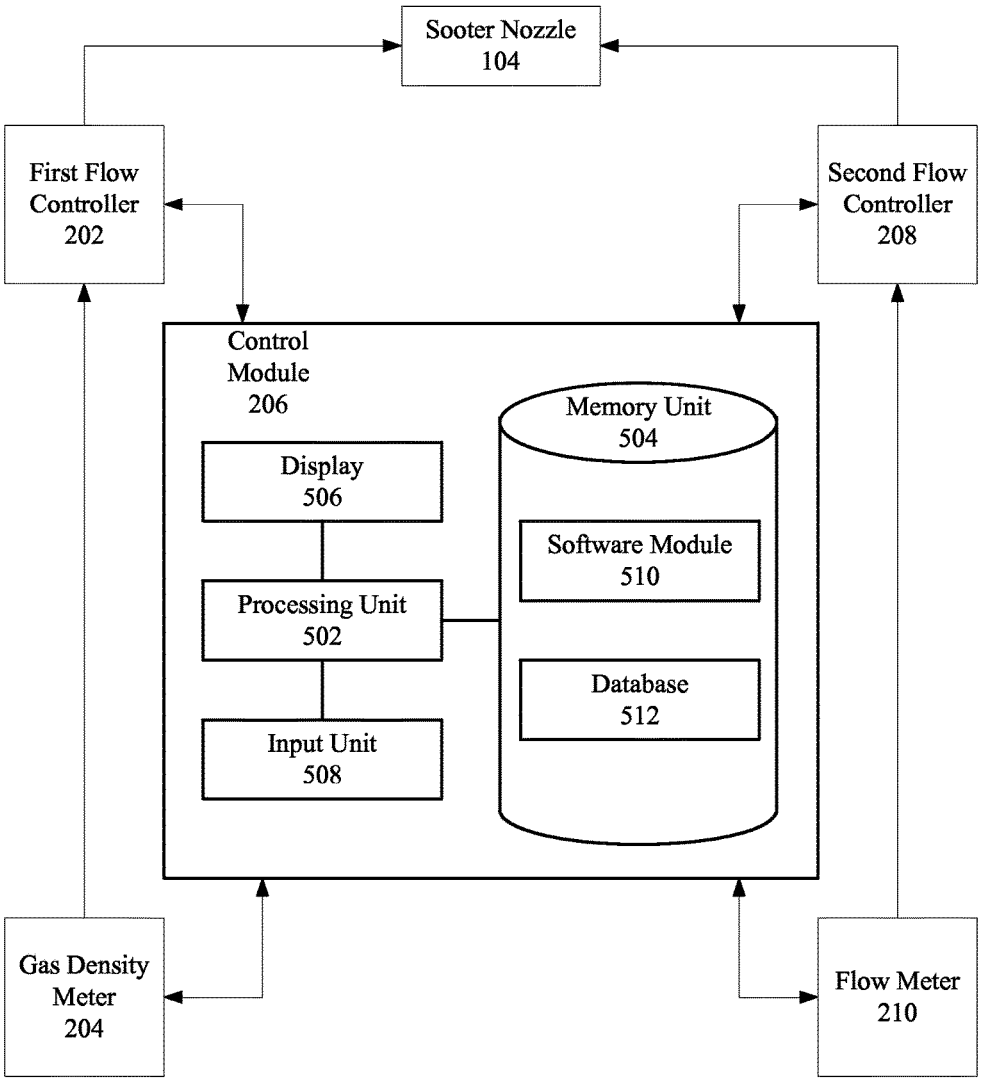
FIG. 5 shows a diagram of a control module.

As shown in FIG. 5, control module 206 may include a processing unit 502, a memory unit 504, a display 506, and an input unit 508. Memory unit 504 may include a software module 510 and a database 512. While executing on processing unit 502, software module 510 may perform processes for controlling a flow, including, for example, one or more stages included in method 300 described below with respect to FIG. 3.

Control module 206 ("the processor") may be implemented using a personal computer, a network computer, a mainframe, a smartphone, or other similar computer-based system. The processor may comprise any computer operating environment, such as hand-held devices, multiprocessor systems, microprocessor-based or programmable sender electronic devices, minicomputers, mainframe computers, and the like. The processor may also be practiced in distributed computing environments where tasks are performed by remote processing devices. Furthermore, the processor may comprise a mobile terminal, such as a smart phone, a cellular telephone, a cellular telephone utilizing wireless application protocol (WAP), personal digital assistant (PDA), intelligent pager, portable computer, a hand held computer, or a wireless fidelity (Wi-Fi) access point. The aforementioned systems and devices are examples and the processor may comprise other systems or devices.

Embodiments, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present invention may be embodied in hardware and/or in software (including firmware, resident software, microcode, etc.). In other words, embodiments of the present invention may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

While certain embodiments have been described, other embodiments may exist. Furthermore, although embodiments have been described as being associated with data stored in memory and other storage mediums, data can also be stored on or read from other types of computer-readable media, such as secondary storage devices, like hard disks, floppy disks, or a CD-ROM, a carrier wave from the Internet, or other forms of RAM or ROM. Further, the disclosed methods' stages may be modified in any manner, including by reordering stages and/or inserting or deleting stages, without departing from the invention.

Embodiments, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as examples for embodiments of the invention.

What is claimed is:

1. A system for protecting a casting wheel from molten material, the system comprising:

a sooter nozzle for depositing soot onto the casting wheel;

a first flow controller configured to control a first gas flow comprising a hydrocarbon fuel gas to the sooter nozzle;

a second flow controller configure to control a second gas flow comprising oxygen to the sooter nozzle;

a gas density meter configured to:

calculate a gas density for the first gas flowing through the gas density meter, and notify the first flow controller via a first signal to alter a first flow rate of the first gas flowing through the first flow controller to cause the sooter nozzle to create a predetermined soot output;

a flow meter in electrical communication with the second flow controller and configured to output a second signal configured to cause the second flow controller to alter a second flow rate of the second gas flowing through the second flow controller; and a control module, configured to alter the flow of the hydrocarbon fuel gas and the flow of the oxygen simultaneously based on the first signal, the second signal, and a density meter signal representing the hydrocarbon fuel gas composition.

2. The system of claim 1, wherein the first signal is configured to notify the first flow controller to maintain a preset flow rate of the first gas flowing through the first flow controller.

3. The system of claim 2, wherein the preset flow rate of the first gas flowing through the first flow controller comprises mass flow rate.

4. A system for protecting a casting wheel from molten material comprising:

a sooter nozzle configured to create a predetermined soot output by combusting a first gas flow and a second gas flow, the sooter nozzle configured for depositing soot onto the casting wheel;

a first flow controller configure to control the first gas flow to the sooter nozzle;

a second flow controller configure to control the second gas flow to the sooter nozzle; and a control module comprising, a memory storage, and a processing unit coupled to the memory storage, wherein the processing unit is operative to:

receive a plurality of parameters comprising a pressure of a tank that provides the first gas flow, a pressure of a tank that provides the second gas flow, an atmospheric pressure near the system, an ambient temperature near the system, a rotation speed of the casting wheel, and a temperature of molten copper being poured into the casting wheel;

determine the predetermined soot output for the sooter nozzle based on the received plurality of parameters; and send a first signal to the first flow controller and a second signal to the second flow controller, the first signal and the second signal configured to respectively cause the first flow controller and the second flow controller to respectively provide a rate of the first gas flow and a rate of the second gas flow configured to cause the sooter nozzle to create the predetermined soot output.

5. The system of claim 4, wherein the sooter nozzle is approximate to the casting wheel, and wherein the sooter nozzle is further configured to deposit the created predetermined soot output on the casting wheel.

6. The system of claim 4, wherein the first gas flow comprises a hydrocarbon fuel gas.

7. The system of claim 4, wherein the first gas flow comprises at least one of the following: ethane; butane; methane; propane; and methylene.

8. The system of claim 4, wherein the first gas flow comprises acetylene.

9. The system of claim 4, wherein the first gas flow comprises ethylene.

10. The system of claim 4, wherein the first gas flow comprises natural gas.

11. The system of claim 4, wherein the first gas flow comprises at least 50% hydrocarbon fuel gas.

12. The system of claim 4, wherein the second gas flow comprises oxygen.

13. The system of claim 1, wherein the first gas flow comprises a hydrocarbon fuel gas.

14. The system of claim 1, wherein the first gas flow comprises at least one of the following: ethane; butane; methane; propane; and methylene.

15. The system of claim 1, wherein the first gas flow comprises acetylene.

16. The system of claim 1, wherein the first gas flow comprises methylene.

17. The system of claim 1, wherein the first gas flow comprises ethylene.

18. The system of claim 1, wherein the first gas flow comprises natural gas.

19. The system of claim 1, wherein the first gas flow comprises at least 50% hydrocarbon fuel gas.

20. The system of claim 1, wherein the second gas flow comprises oxygen.

* * * * *